US005541700A

United States Patent [19]

Earle et al.

[11] Patent Number: 5,541,700

[45] Date of Patent: Jul. 30, 1996

[54] SEPARATION OF LIQUIDS

[75] Inventors: Anthony Earle, Harrow Weald; John F. Daehne, Watford, both of England

[73] Assignee: Eastman Kodak Company, Rochester, N.Y.

[21] Appl. No.: 324,278

[22] Filed: Oct. 14, 1994

[30] Foreign Application Priority Data

Oct. 19, 1993 [GB] United Kingdom ..... 9321550

[51] Int. Cl.[6] ..... G03D 3/02

[52] U.S. Cl. ..... 354/324

[58] Field of Search ..... 354/324, 322, 354/323; 422/82, 137, 138, 133; 204/1 T, 614, 615, 269, 270; 356/301; 55/16; 210/137, 219, 199, 205, 752, 760; 134/170, 29, 171; 209/170, 169

[56] References Cited

U.S. PATENT DOCUMENTS

| | | | |
|---|---|---|---|
| 3,824,616 | 7/1974 | Uchida | 354/339 |
| 4,001,855 | 1/1977 | Wilheim | 354/324 |
| 4,212,845 | 7/1980 | Stelling et al. | 422/82 |
| 4,676,274 | 6/1987 | Brown | 422/82 X |
| 4,802,761 | 2/1989 | Bowen et al. | 356/301 |
| 4,838,999 | 6/1989 | Haar et al. | 204/1 T |
| 5,053,060 | 10/1991 | Kopf-Sill et al. | 55/16 |

FOREIGN PATENT DOCUMENTS

| | | | |
|---|---|---|---|
| 1292004 | 10/1972 | Germany | G03D 3/12 |
| 2710879 | 9/1978 | Germany . | |
| 58-42048 | 3/1983 | Japan | G03D 13/00 |
| 1-319038 | 12/1989 | Japan | 354/323 |
| 3-62033 | 3/1991 | Japan | G03D 3/00 |
| 1-68349 | 2/1992 | Japan | 354/323 |
| 5-134379 | 5/1993 | Japan | 354/323 |
| 575609 | 11/1977 | Russian Federation | G03D 3/12 |
| 644356 | 10/1950 | United Kingdom | 98/D2 |

*Primary Examiner*—D. Rutledge
*Attorney, Agent, or Firm*—Frank Pincelli

[57] ABSTRACT

In photographic processing apparatus, different processing solutions are normally contained in separate tanks, the material being processed as it passes from one tank to another through the required processing stages. This means that the apparatus needs to have a tank for each solution which is required for a particular process. Described herein is an arrangement in which more than one processing tank may be provided in a single container. The arrangement comprises tray which is divided into two portions by barrier means, each portion containing a different processing solution. The barrier means, includes an air bubble retained on the underside of a curved member which is maintained in a central position due to the liquid pressure on each side of the barrier means.

8 Claims, 5 Drawing Sheets

SEPARATION OF LIQUIDS

FIELD OF THE INVENTION

The present invention relates to the separation of liquids and is more particularly, although not exclusively, concerned with the separation of liquids in photographic processing apparatus.

BACKGROUND OF THE INVENTION

In photographic processing apparatus, different processing solutions are contained in separate tanks, the material being processed as it passes from one tank to another through the required processing stages. This means that the apparatus needs to have a separate tank for each solution which is required for a particular process—for example, a tank for each of the developer, bleach, fix (or combined bleach/fix) and wash stages, the material being processed making contact with the air as it passes from one tank to the next.

Moreover, such processing apparatus usually comprises more than one washing stage and hence there is a requirement for a separate wash tank for each of the washing stages. As a result, such processing apparatus tend to be large and cumbersome.

U.S. Pat. No. 3,824,616 describes an automatic film processor which comprises a plurality of treatment tanks and a transport system for transporting a sheet of film through the tanks in succession. In this processor, the film sheet enters the air as it crosses over from one tank to another. A guide structure is provided between adjacent tanks to guide the film sheet as it passes through the air between the adjacent tanks. The film sheet is processed with its emulsion surface outermost. A positive air pressure is produced adjacent the interior of the guide structure to urge the sheet of film away therefrom to minimize faulty processing and scratching of the emulsion surface of the film sheet.

Although U.S. Pat. No. 3,824,616 describes a processor which overcomes the problem of the film sheet making contact with the guide structure as it crosses over from one tank to the next, the processor is still large and requires several separate tanks.

GB-A-1 292 004 discloses a compact processor in which the processing tanks are nested within one the other. The processor comprises a first container mounted on a support and a second container positioned within the first container but spaced therefrom to define a processing tank therebetween. One processing solution is contained in the processing tank defined by the walls of the two containers, and a second different processing solution is contained in the second container. A cross-over arrangement is provided so that the material being processed can pass from the first container and the solution contained therein into the second container and the solution contained therein. In the cross-over arrangement, the material being processed makes contact with the air. It is also possible to introduce material directly into the second container for processing without it having to pass initially through the first container.

PROBLEM TO BE SOLVED BY THE INVENTION

The requirement for several processing tanks, and in particular several wash tanks, one for each washing stage, tends to make the processing apparatus relatively large and cumbersome.

Excessive contact with the air as material is being passed from one tank to the next has an effect on the overall processing time. This air contact may also affect the stability of the processing solutions used.

SUMMARY OF THE INVENTION

It is therefore an object of the present invention to provide a method of processing photographic material in which contact with the air between processing solutions is substantially reduced.

It is a further object of the present invention to provide a method of separating liquids which enables the number of processing tanks to be substantially reduced, particularly although not exclusively, in the washing stages of a photographic process.

It is another object of the present invention to provide apparatus which is more compact and space efficient than apparatus presently available, particularly with a reduction in the number of processing tanks.

In accordance with one aspect of the present invention, there is provided a method of separating liquids meeting at an interface characterized in that diffusion limiting means is introduced at the interface between the two liquids to separate them.

In accordance with a second aspect of the present invention, there is provided apparatus for separating liquids at an interface characterized in that a chamber is provided at the interface in which a bubble is formed.

In accordance with a third aspect of the present invention, there is provided a method of processing photographic material in a plurality of processing solutions, characterized in that the material is passed from one solution to another without air contact, the solutions being separated from one another by diffusion limiting means.

In accordance with a fourth aspect of the present invention, there is provided photographic processing apparatus comprising a processing tank containing at least two processing solutions, characterized in that diffusion limiting means is provided at an interface between two of the processing solutions.

Advantageously, the diffusion limiting means comprises a bubble positioned at an interface between the two adjacent solutions.

The bubble may be a gas bubble. The gas may be air or preferably an inert gas.

ADVANTAGEOUS EFFECT OF THE INVENTION

In accordance with the present invention, it is possible to provide a processing apparatus in which the material being processed makes no contact with the air as it is passed from one processing tank to the next.

By this arrangement, a simple, inexpensive system is provided which enables two or more liquids to be separated from each other in the same container.

A processing tank is defined as a container having a processing solution therein, and may comprise a single container containing more than one processing solution, each solution being separated from an adjacent solution by diffusion limiting means.

Diffusion limiting means is defined as a barrier which prevents the diffusion of fluid from one area to another in the same container.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
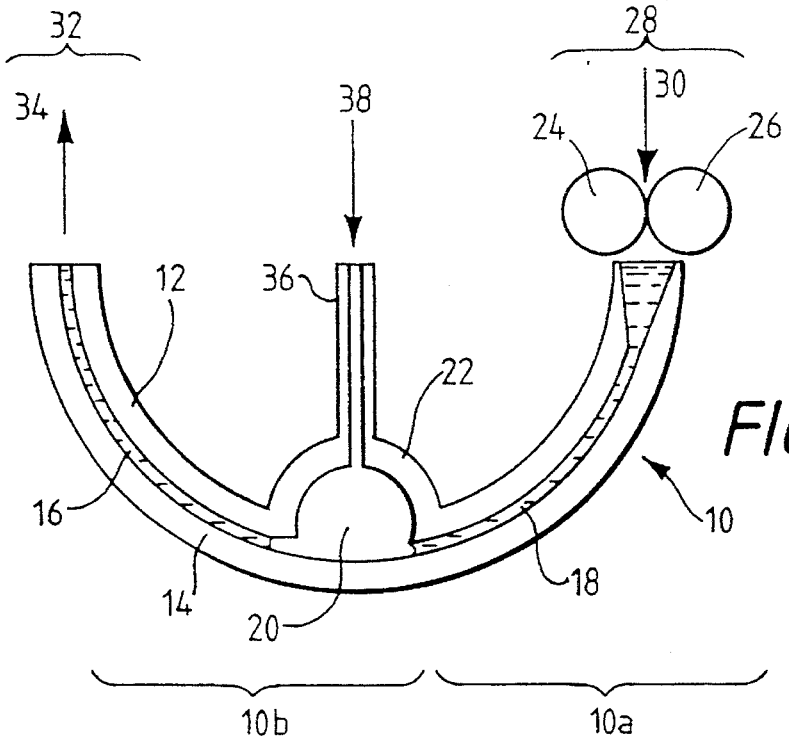
FIG. 1 is a cross-section through a portion of a wash tank in photographic processing apparatus constructed in accordance with the present invention.

FIG. 1 illustrates a portion of a photographic wash tank 10 in accordance with the present invention. The wash tank 10 comprises a thin tank defined by wall portions 12, 14. Wash water 16, 18 is confined between the wall portions 12, 14 and is separated into two portions 16, 18 as shown by an air bubble 20 maintained in a hemi-spherical chamber 22 formed in wall portion 12. Drive rollers 24, 26 are provided at an inlet 28 to the tank 10 to drive material being processed, for example, photographic paper (not shown), through the wash tank 10 (in the direction indicated by arrow 30). The material leaves the tank 10 at outlet 32 (in the direction indicated by arrow 34).

Air bubble 20 is introduced into and maintained in the hemi-spherical chamber 22 by means of tube portion 36 connected to the chamber 22. Air is pumped into the chamber 22, via tube portion 36, in the direction indicated by arrow 38. The presence of the air bubble 20 divides the tank 10 into two wash tank portions 10*a*, 10*b*. If the pressure of the air inside chamber 22 is kept the same as the liquid pressure in the wash tank portions 10*a*, 10*b*, the material can be transported from one tank portion 10*a* to the other tank portion 10*b* through the air bubble 20.

Figure 2:
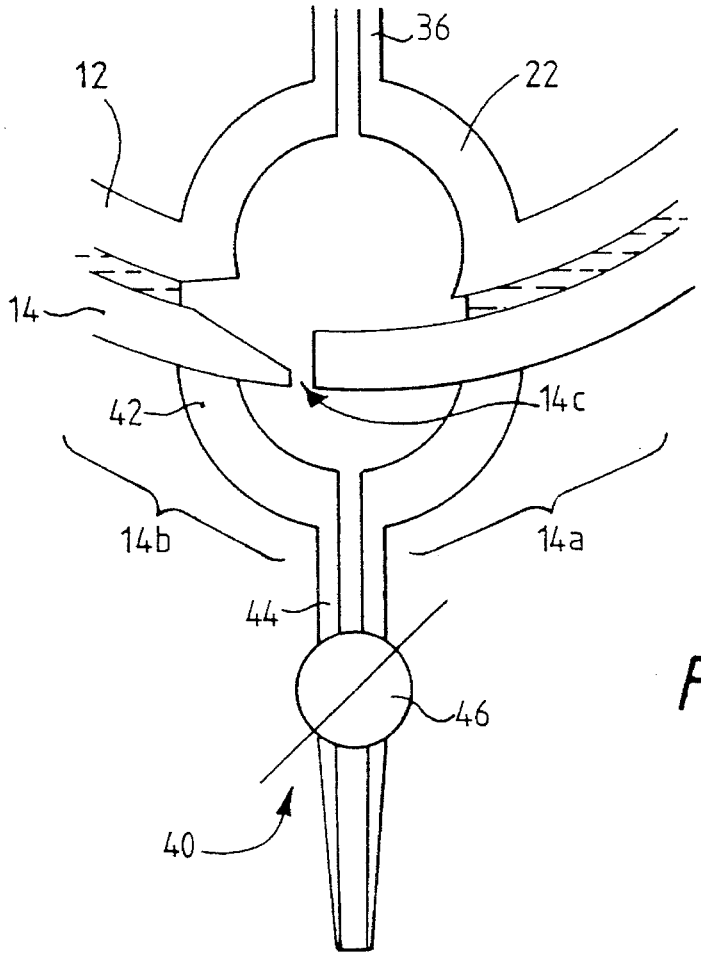
FIG. 2 is an enlarged view of the bottom portion of the wash tank shown in FIG. 1 which has been modified to provide a drain.

FIG. 2 is an enlarged view of the lower end of tank 10 with a modification Which allows the chamber 22 to be drained should any liquid accumulate therein. Wall portion 14 is modified to allow a drain arrangement 40 to be fitted, that is, the wall portion 14 is divided into two parts 14*a*, 14*b* with a gap 14*c* formed therebetween. The drain arrangement 40 comprises a hemispherical chamber 42 attached to both parts 14*a*, 14*b* of wall portion 14, a tube portion 44 and a valve 46 in the tube portion 44. Any liquid accumulating in the chamber 22 can then fall under gravity into the hemi-spherical chamber 42 through gap 14*c* in wall portion 14. The liquid can then be drawn off by operation of the valve 46.

It will be readily appreciated that chambers 22, 42 need not be hemi-spherical but of any other suitable configuration.

Figure 3:
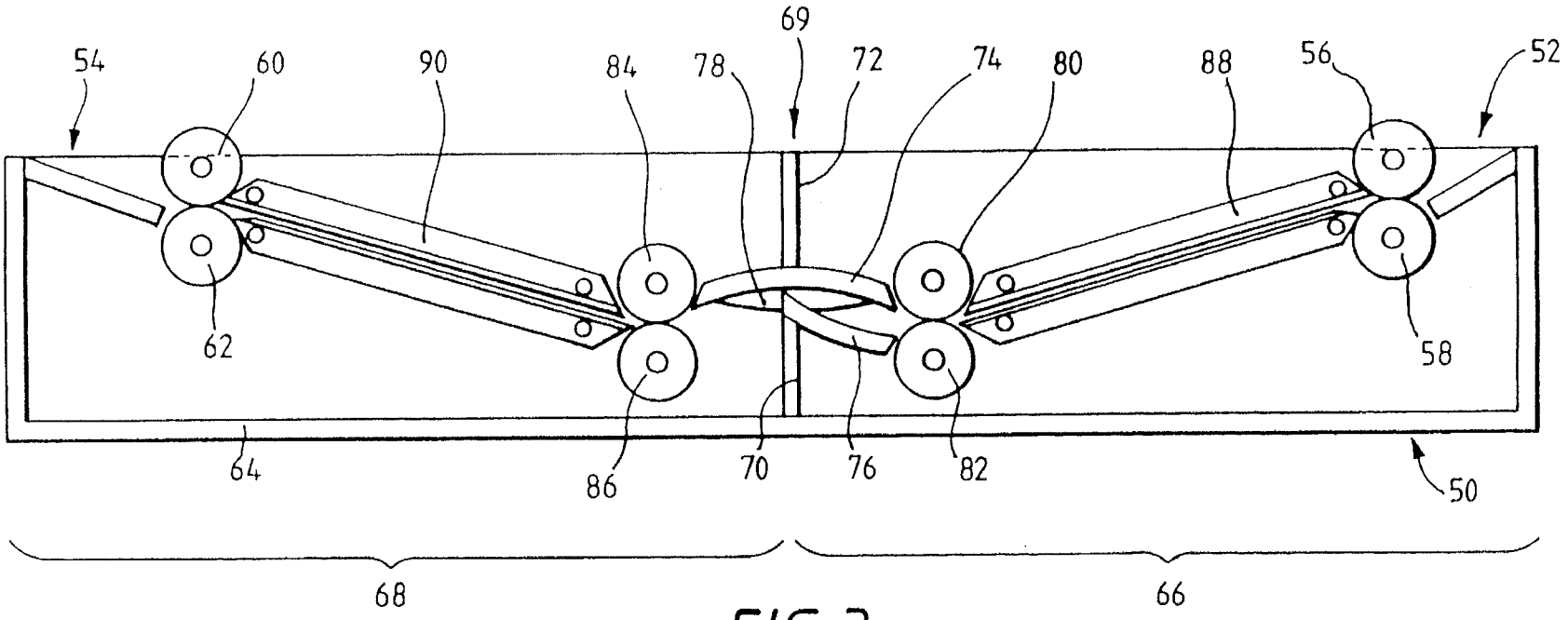
FIG. 3 is a schematic view of one embodiment of a practical arrangement of apparatus in accordance with the present invention.

FIG. 3 illustrates a simple two bath processor 50 having an inlet 52 and an outlet 54. Pairs of rollers 56, 58 and 60, 62 are provided at the inlet 52 and the outlet 54 respectively to transport the material being processed into and out of the processor 50.

The processor 50 comprises a tray arrangement 64 which is divided into two separate portions 66, 68 by a barrier 69 comprising sections 70, 72, 74, 76. Sections 74, 76 are both curved as shown to trap air bubble 78 and to guide material being processed through the air bubble 78, respectively.

Additional drive roller pairs 80, 82 and 84, 86 are provided to transport the material through the processor 50.

Guide members 88, 90 are provided in respective portions 66, 68 to guide the material between roller pairs 56, 58 and 80, 82 and 84, 86 and 60, 62.

In use, material to be processed passes into the processor 50 at the inlet 52, through roller pair 56, 58 and into tray portion 66. Roller pair 56, 58 then directs the material into guide member 88, through roller pair 80, 82 and into barrier 69. As the material passes through barrier 69, it enters the air bubble 78 and then passes into tray portion 68. Roller pair 84, 86 directs the material into guide member 90 and on to roller pair 60, 62 at outlet 54.

Figure 4:
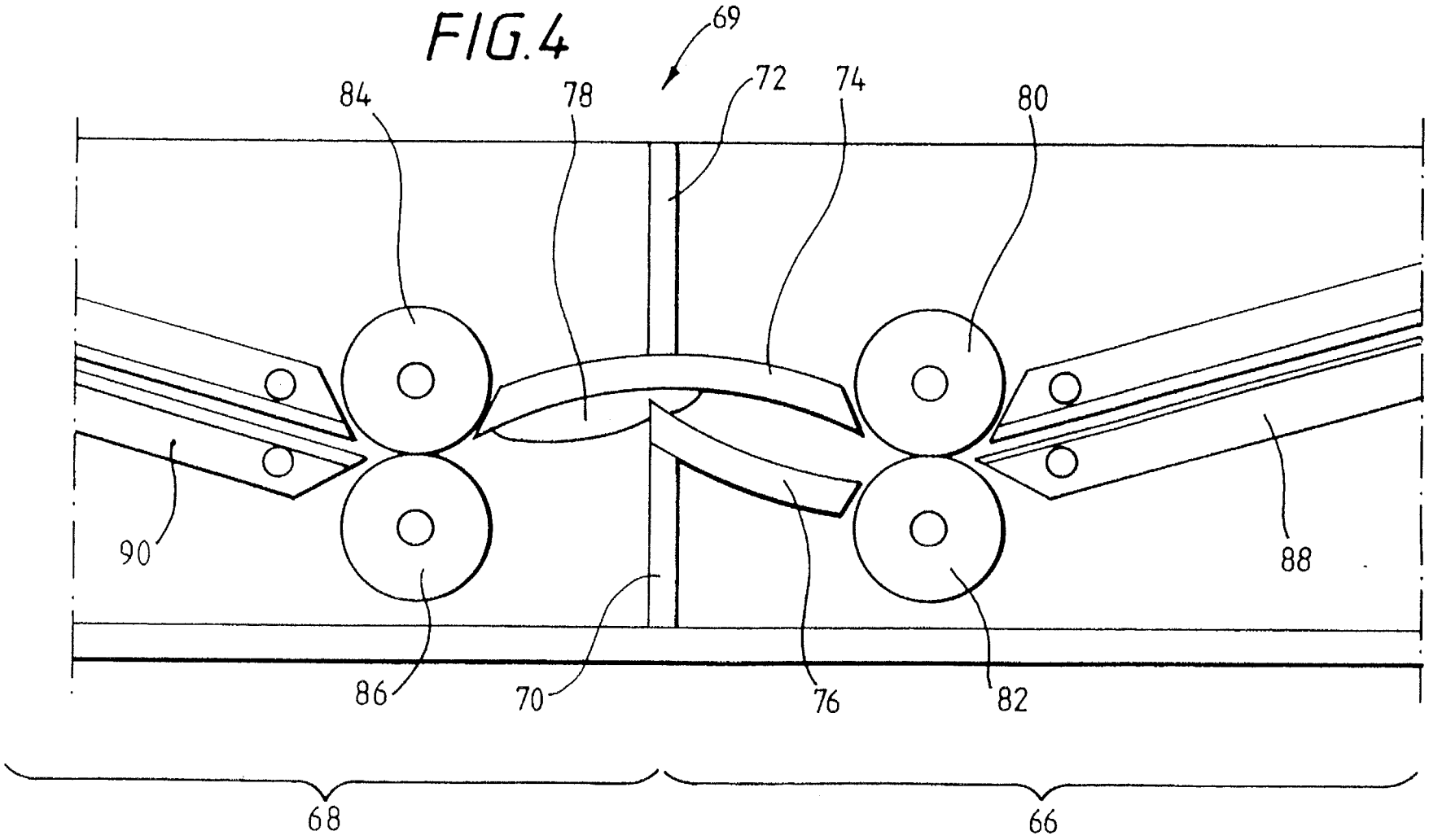
FIG. 4 is an enlarged view of the diffusion inhibiting barrier of the FIG. 3 arrangement illustrating displacement of the air bubble.

FIG. 4 is an enlarged view of the air bubble 78 formed by barrier sections 70, 72, 74, 76. In this case, the air bubble 78 is shown displaced to one side, that is, so that it lies more into portion 68. This displacement of the air bubble 78 may be due to different liquid levels in the two portions 66, 68 (not shown). For example, on replenishment of portion 66, a difference in liquid height is produced forcing the air bubble 78 to the left as shown. Similarly, replenishment of portion 68 will increase the height of the liquid in that portion and force the air bubble 78 back to a more central position as shown in FIG. 3.

It is appears that the amount of liquid head height difference which can be tolerated by the air bubble 78 is solely dependent on the curvature of section 74.

Solutions in each section 66, 68 of the tray arrangement 74 can be circulated by small pumps (not shown).

The processor 50 is filled by simply pouring the two solutions into their respective sections at the same time so that the levels on either side are approximately the same. The air bubble 78 has been shown to be self-establishing under these conditions.

In accordance with the present invention, it will be readily appreciated that the amount of time spent in air as the material passes from one processing solution to the next is related to the size of the air bubble 78.

Figure 5:
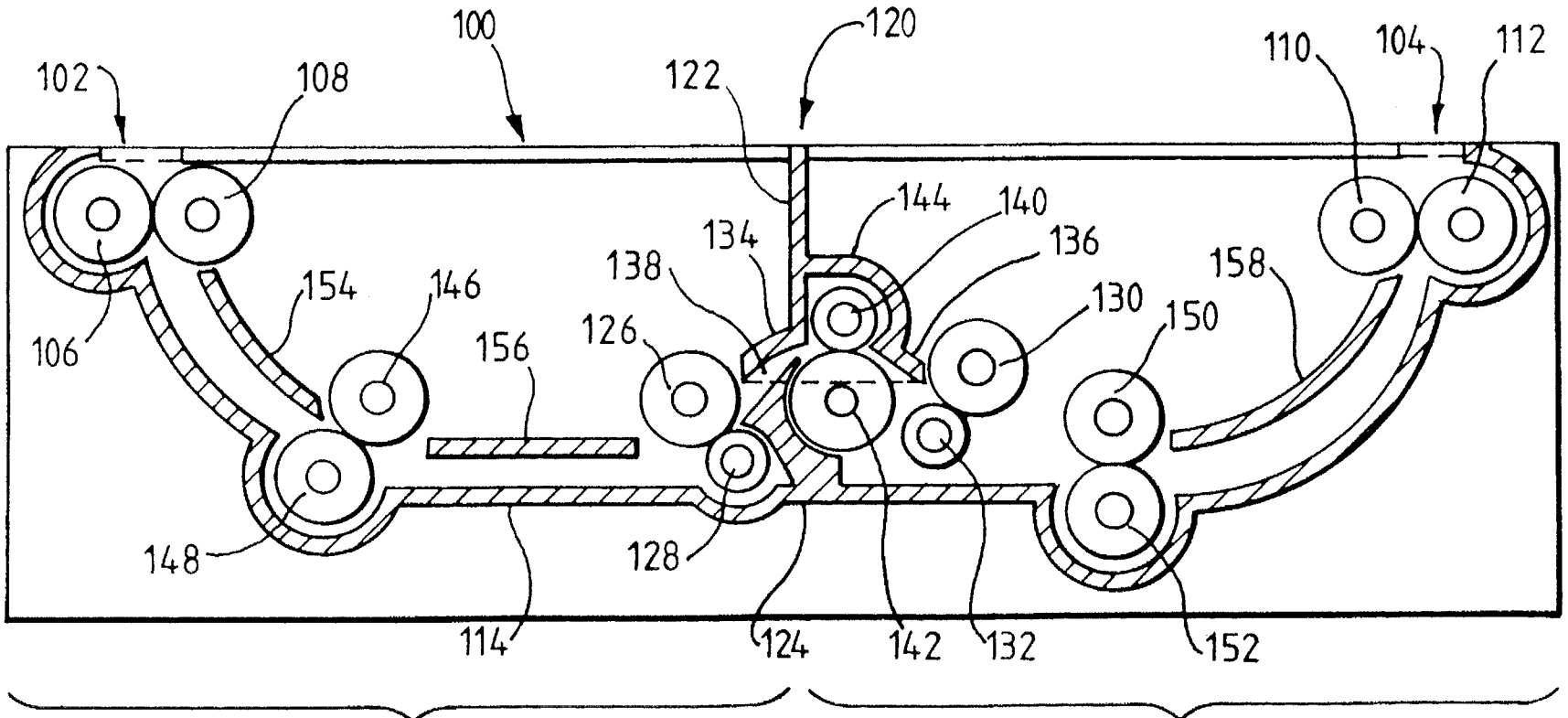
FIG. 5 is a schematic view of another embodiment of a practical arrangement of apparatus in accordance with the present invention.
Figure 6:
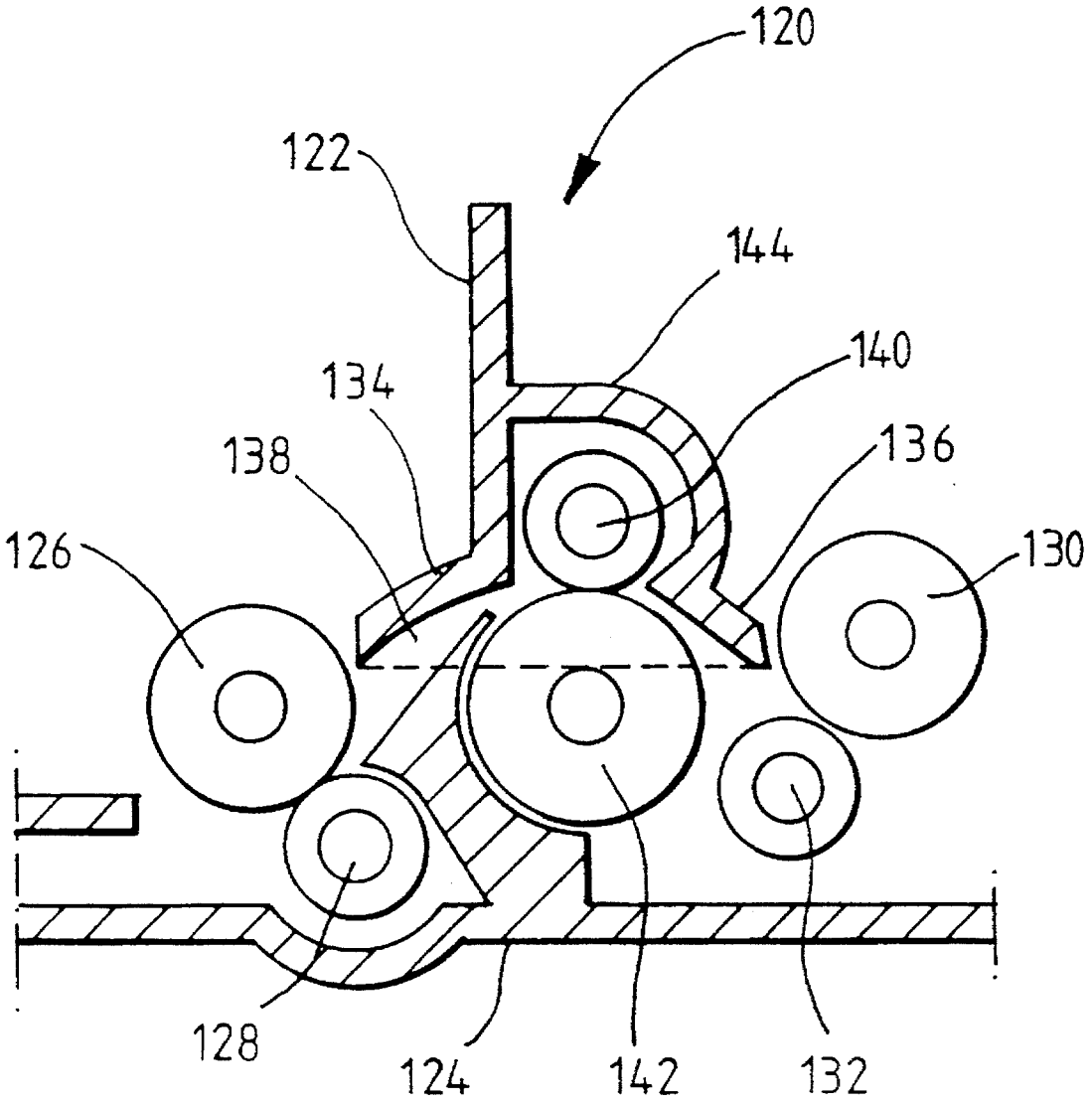
FIG. 6 is an enlarged view of the diffusion inhibiting barrier of the FIG. 5 arrangement.

FIGS. 5 and 6 illustrate another simple two bath processor 100 having an inlet 102 and an outlet 104. Pairs of rollers 106, 108 and 110, 112 are provided at the inlet 102 and the outlet 104 respectively to transport the material being processed into and out of the processor 100.

The processor 100 comprises a shaped tray 114 divided into two portions 116, 118 by a barrier arrangement 120. Each portion 116, 118 contains a different processing solution (not shown). The barrier arrangement 120 comprises wall section 122, guide section 124 and roller pairs 126, 128 and 130, 132 as shown. Wall section 122 comprises two curved portions 134, 136 which allow an air bubble 138, indicated by a dotted line, to be established. This is shown more clearly in FIG. 6. Roller pairs 126, 128 and 130, 132 together with guide section 124 guide the material through the barrier arrangement 120.

An additional roller pair 140, 142 is positioned within the barrier arrangement 120 to assist with the guiding of the material therethrough. The roller pair 140, 142 also act as squeegee rollers to remove excess liquid from the surface of the material as it enters the barrier arrangement 120 and leaves the first processing solution (not shown). Roller 142 is positioned adjacent guide section 124 and roller 140 is located above roller 142 in portion 144 of wall section 122.

Additional roller pairs 146, 148 and 150, 152 are positioned in the tray 114 to guide the material. Guide wall portions 154, 156, 158 provide extra guidance between the roller pairs 106, 108 and 146, 148, roller pairs 146, 148 and 126, 128, and roller pairs 150, 152 and 110, 112 as shown.

Tray 114 has a generally trough-shaped cross-section with portions of generally semi-circular cross-section for receiving rollers 106, 112, 128, 148, 152 as shown. Naturally, other suitable configurations may be utilized for the tray 114.

It is to be noted that the embodiments of the present invention described above require no moving parts to provide the desired separation between the two liquids. The separation is achieved by establishing a bubble between the two liquids. In the embodiments shown in FIGS. 3 to 6, this is determined by the geometry of the barrier arrangements 69, 120, and in particular, the curvature of sections 74 (FIGS. 3 and 4) and 134, 136 (FIGS. 5 and 6). Pressurization of the bubble is due to the static head of liquids on either side thereof.

Although the present invention has been described with reference to establishing air bubbles 20, 78, 138, it is to be noted that the invention is not so limited. Any suitable fluid could be used to provide the desired separation. Naturally, the choice of fluid will depend on the two liquids which are to be separated.

Preferably, the fluid is a gas.

If the two liquids to be separated form two stages of a multi-stage wash process in a photographic process, the gas could be air as there will be no chemical reaction between the water and the air.

On the other hand, if one of the liquids is a developer solution, which reacts with air, it is still possible to utilize air in the bubble. This is because the initial amount of oxygen in the present in the bubble will quickly be used up and no further chemical reaction between the developer solution and the air will be possible. This is because the volume of the air in the bubble is fixed and becomes stagnant and inert once all the oxygen has been used up.

It may be advantageous if the gas separating the two liquids is saturated with the first of the two solutions, for example, developer solution, so that processing time for the material being processed can be increased through the bubble and until the material enters next processing solution.

Although the embodiments described with respect to FIGS. 1 to 6 incorporate an air bubble to separate two processing stations in a single tank, other means of achieving such separation can be used.

Parts List

10,10*a*,10*b* . . . tank
12,14,14*a*,14*b*,14*c* . . . wall portions
16,18 . . . wash water
20 . . . air bubble
22,42 . . . hemi-spherical chambers
24,26 . . . drive rollers
28 . . . inlet
30,34,38 . . . arrows
32 . . . outlet
36 . . . tube portion
40 . . . drain arrangement
44 . . . tube portion
46 . . . valve
50 . . . two bath processor
52 . . . inlet
54 . . . outlet
56,58,60,62 . . . pair of rollers
64 . . . tray arrangement
66,68 . . . tray portions
69 . . . barrier
70,72,74,76 . . . sections
78 . . . air bubble
80,82 . . . roller pair
84,86 . . . roller pair
88,90 . . . guide members
100 . . . two bath processor
102 . . . inlet
104 . . . outlet
106,108,110,112 . . . pair of rollers
104 . . . shaped tray
106,118 . . . portions
120 . . . barrier arrangement
122 . . . wall section
124 . . . guide section
126,128,130,132 . . . roller pairs
134,136 . . . curved portions
138 . . . air bubble
140,142 . . . roller pair
144 . . . portion
146,148,150,152 . . . roller pairs
154,156,158 . . . guide wall portions

We claim:

1. A method of processing photographic material in a plurality of processing solutions, the method comprising the steps of:

providing a plurality of processing solutions;

forming an interface between two adjacent processing solutions;

separating two adjacent processing solutions at the interface;

passing the photographic material from one processing solution to another adjacent processing solution through the interface formed between the two adjacent solutions;

characterized in that the method further comprises the steps of forming a bubble at the interface and maintaining the bubble to separate the two processing solutions.

2. A method according to claim 1, wherein the bubble is a gas bubble.

3. A method according to claim 2, wherein the gas is inert.

4. A method according to claim 2, wherein the gas is air.

5. A method according to claim 1, wherein the bubble is pressurized due to the static head of liquid on either side thereof.

6. Apparatus for separating liquids at an interface characterized in that a chamber is provided at the interface in which a bubble is formed and maintained, the bubble providing the separation between the two liquids at the interface.

7. Photographic processing apparatus comprising a processing tank containing at least two processing solutions, two processing solutions meeting at an interface, characterized in that a bubble is formed and maintained in a chamber at the interface between the two processing solutions.

8. A method of separating liquids which meet at an interface, the method comprising the steps of:

providing a chamber at the interface;

forming a bubble in the chamber at the interface; and maintaining the bubble to prevent mixing of the liquids.

* * * * *